US010131520B2

(12) United States Patent
Kattainen et al.

(10) Patent No.: US 10,131,520 B2
(45) Date of Patent: Nov. 20, 2018

(54) METHOD AND TEST SYSTEM FOR TESTING FAILURE OF A MACHINERY BRAKE OF AN ELEVATOR BASED ON ELEVATOR MACHINE OSCILLATION

(71) Applicants: Ari Kattainen, Hyvinkaa (FI); Tapio Tyni, Hyvinkaa (FI)

(72) Inventors: Ari Kattainen, Hyvinkaa (FI); Tapio Tyni, Hyvinkaa (FI)

(73) Assignee: KONE Corporation, Helsinki (FI)

( * ) Notice: Subject to any disclaimer, the term of this patent is extended or adjusted under 35 U.S.C. 154(b) by 399 days.

(21) Appl. No.: 14/919,913

(22) Filed: Oct. 22, 2015

(65) Prior Publication Data

US 2016/0039636 A1 Feb. 11, 2016

Related U.S. Application Data

(63) Continuation of application No. PCT/FI2014/050392, filed on May 21, 2014.

(30) Foreign Application Priority Data

May 22, 2013 (FI) ..... 20135547

(51) Int. Cl.

| | |
|---|---|
| ***B66B 1/34*** | (2006.01) |
| ***B66B 5/00*** | (2006.01) |
| ***B66D 5/30*** | (2006.01) |

(52) U.S. Cl.

CPC ..... *B66B 5/0037* (2013.01); *B66B 5/0025* (2013.01); *B66B 5/0031* (2013.01); *B66D 5/30* (2013.01)

(58) Field of Classification Search

CPC ... B66B 5/0037; B66B 5/0025; B66B 5/0031; B66B 5/30

(Continued)

(56) References Cited

U.S. PATENT DOCUMENTS 3,838,891 A * 10/1974 Hamelin ..... B60T 8/885 188/DIG. 1

4,717,865 A 1/1988 Caputo (Continued)

FOREIGN PATENT DOCUMENTS

EP 2306630 A1 4/2011
EP 2460753 A1 6/2012

(Continued)

OTHER PUBLICATIONS

Extended European Search Report dated Dec. 19, 2016 issued in corresponding European Patent Application No. 14800684.4.

(Continued)

*Primary Examiner* — Anthony Salata
(74) *Attorney, Agent, or Firm* — Harness, Dickey & Pierce, P.L.C.

(57) ABSTRACT

The purpose of the invention is to detect a failure situation wherein the machinery brake of an elevator does not open sufficiently. In the method for testing failure of a machinery brake of an elevator, the machinery brake is controlled to open. After this, the traction sheave is oscillated with a test torque, the movement of the elevator machine is measured in connection with the oscillation, and if the machine does not move in connection with the oscillation, it is deduced that the machinery brake has not opened and has therefore failed.

12 Claims, 1 Drawing Sheet

(58) Field of Classification Search
USPC ..... 187/247, 288, 391, 393
See application file for complete search history.

(56) References Cited

U.S. PATENT DOCUMENTS

| | | | | |
|---|---|---|---|---|
| 4,733,148 | A * | 3/1988 | Rodi | B41F 13/0008 318/490 |
| 4,833,380 | A | 5/1989 | Magee | |
| 4,928,021 | A * | 5/1990 | Yonemoto | B66B 1/32 187/288 |
| 6,655,662 | B2 * | 12/2003 | Kemppainen | B66C 13/23 212/270 |
| 7,148,652 | B2 * | 12/2006 | Ghanemi | B66B 5/02 318/805 |
| 7,222,698 | B2 * | 5/2007 | Hanninen | B66B 5/0093 187/393 |
| 7,293,761 | B2 * | 11/2007 | Malek | B66C 15/065 254/275 |
| 7,350,883 | B2 * | 4/2008 | Hubbard | B66B 5/0018 187/393 |
| 8,205,721 | B2 * | 6/2012 | Korhonen | B66B 1/32 187/288 |
| 8,746,413 | B2 * | 6/2014 | Schroeder-Brumloop | B66B 5/0093 187/288 |
| 9,463,956 | B2 * | 10/2016 | Lahteenmaki | B66B 5/0037 |
| 2002/0023803 | A1 | 2/2002 | Vaisanen | |
| 2008/0067011 | A1 * | 3/2008 | Gremaud | B66B 5/0037 187/359 |
| 2010/0154527 | A1 * | 6/2010 | Illan | B66B 5/0093 73/121 |
| 2012/0217100 | A1 | 8/2012 | Spirgi et al. | |

FOREIGN PATENT DOCUMENTS

| | | | |
|---|---|---|---|
| JP | 04-265681 | | 9/1992 |
| JP | 2008-001524 | A | 1/2008 |
| JP | 2008-162776 | A | 7/2008 |
| JP | 4298418 | B2 | 7/2009 |
| WO | WO-2005/066057 | A2 | 7/2005 |
| WO | WO-2007094777 | A2 | 8/2007 |

OTHER PUBLICATIONS

International Search Report PCT/ISA/210 for International Application No. PCT/FI2014/050392 dated Jul. 23, 2014.

Written Opinion of the International Searching Authority PCT/ISA/237 for International Application No. PCT/FI2014/050392 dated Jul. 23, 2014.

Finish Search Report for Application No. 20135547 dated Jan. 29, 2014.

* cited by examiner

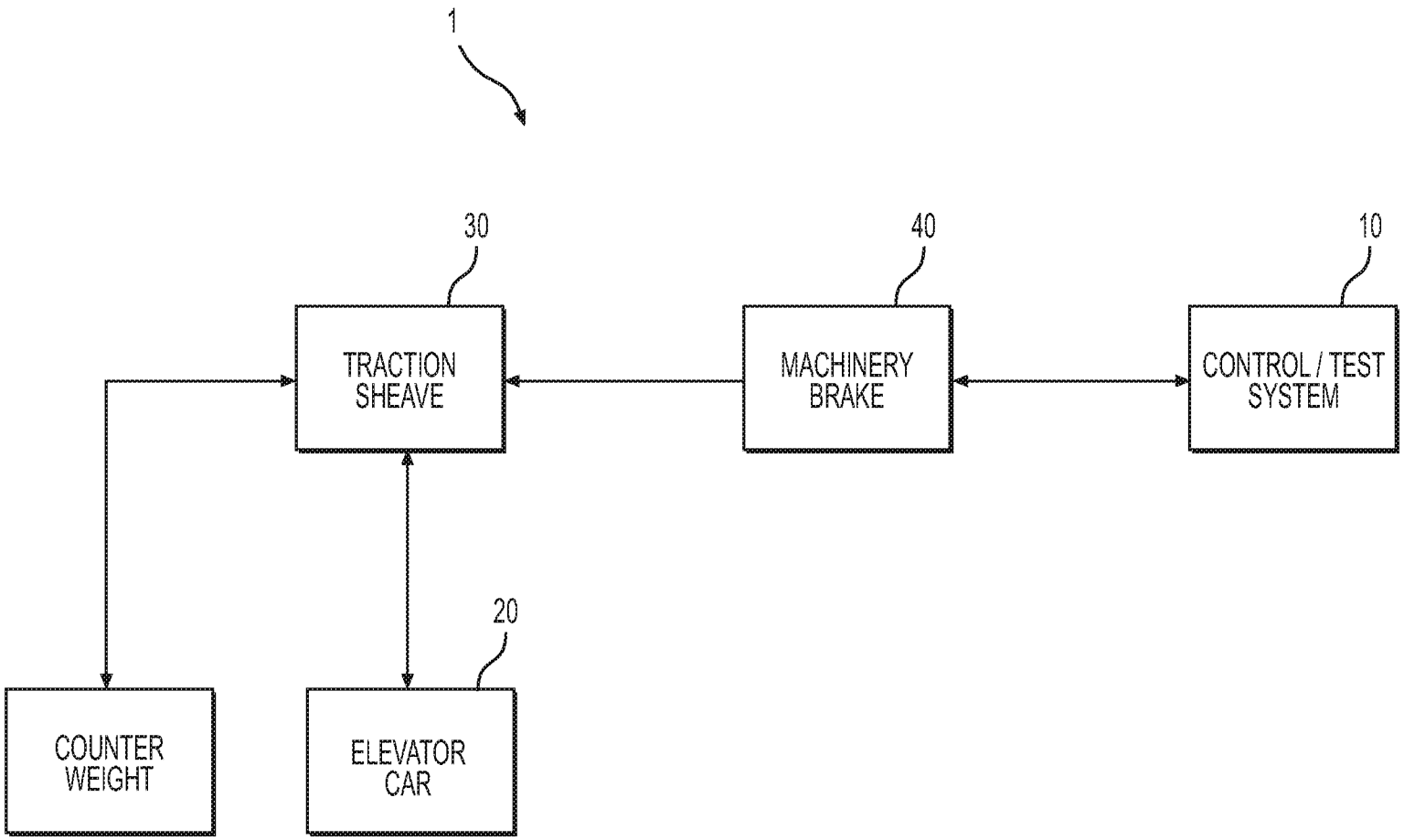
1
10
CONTROL / TEST SYSTEM
40
MACHINERY BRAKE
30
TRACTION SHEAVE
20
ELEVATOR CAR
COUNTER WEIGHT

METHOD AND TEST SYSTEM FOR TESTING FAILURE OF A MACHINERY BRAKE OF AN ELEVATOR BASED ON ELEVATOR MACHINE OSCILLATION

This application is a continuation of PCT International Application No. PCT/FI2014/050392 which has an International filing date of May 21, 2014, and which claims priority to Finnish patent application number 20135547 filed May 22, 2013, the entire contents of both of which are incorporated herein by reference.

FIELD OF THE INVENTION

The invention relates to the field of elevator technology and to the testing of the operation of machinery brakes of elevators.

TECHNICAL BACKGROUND

From the viewpoint of elevator safety, the machinery brakes of an elevator are a critical component. The functioning of the machinery brakes of an elevator must also be monitored and the elevator must be removed from use when a machinery brake is out of order.

In many modern elevator systems a frequency converter is used to control the elevator motor and the elevator motor is driven with a pulse-width-modulated signal. Particularly in these types of elevator systems, adjustment of the deceleration and speed of an elevator car is generally implemented by adjusting the frequency of the frequency converter or the width of the active-pulse window. A machinery brake only needs to be used in an emergency situation. In addition, a machinery brake is generally engaged when an elevator car has stopped at the point of a floor level for taking passengers or a load on board or for letting it/them out of the elevator car. In this type of elevator system a sudden failure of a machinery brake is at least theoretically possible.

Testing of a brake for possible failure is a part of the monitoring of the operation of brakes. Failure of a machinery brake is involved e.g. if/when the machinery brake does not stop the elevator car or is not able to hold the elevator car in position, but also if/when the machinery brake does not open when driving with the elevator machine or when torque is produced with the elevator machine. It is obvious that if/when the machinery brake does not stop the elevator car a dangerous situation is at hand. But a dangerous situation might also arise if the machinery brake does not open sufficiently, because the machinery brake might become broken e.g. as a result of overheating, in which case adequate braking force will not be obtained from it in an emergency situation. If when driving the motor against the brake the braking force suddenly decreases, the elevator car can rush out of control.

Numerous solutions are known in the art for measuring the stopping force of a machinery brake.

The international patent application publication WO 2005/066057 A2 of the applicant presents a method and a system for testing the condition of the brakes of an elevator. In the starting situation the elevator car is provided with an additional weight and a drive device is used for moving the elevator car upwards. The torque needed for making it move upwards is measured. After this the additional weight is removed. In the monitoring to be implemented at regular intervals, it is endeavored to drive the elevator with the brake on in a starting situation with a measured torque. If the elevator moves, it can be deduced that the brake has failed.

Otis Elevator Company's international patent application publication WO 2007/094777 A2 presents a method wherein the elevator car is stopped near a position switch and the brake of the elevator is closed. After this drive motor of the elevator is driven for pulling the elevator by means of a rope. If the elevator car moves in such a way that the state of the position switch changes, it is deduced that the brake is broken.

The invention in the method described in AG's European patent application publication EP 2 460 753 A1 closes the brake of an elevator and increases the torque of the motor until the elevator car moves. The torque is compared to a threshold value and if the threshold value is smaller than the limit value it is deduced that the brake has failed.

Many fewer methods are known in the art, however, for testing sufficient opening of machinery brakes. In some elevator systems brake switches have been used, which brake switches change their state when the brake opens, i.e. when the brake shoe detaches from a rotating part of the machine. The power supply to the electric motor of the hoisting machine is disconnected if there is no change in state of the brake switch. Brake switches are expensive and subject to failure. For example, the switch contacts of a brake switch can oxidize.

PURPOSE OF THE INVENTION

According to a first aspect, the purpose of the invention is to enable detection of the failure of a machinery brake of an elevator originating from insufficient opening.

This purpose can be resolved with a method in which the machinery brake is controlled to open; after this, the traction sheave is oscillated with a test torque; the movement of the elevator machine is measured in connection with the oscillation; and if the machine does not move in connection with the oscillation, it is deduced that the machinery brake has not opened and has therefore failed, and with a test system comprising a control means of the machinery brake for controlling the machinery brake to open; a control means of the machine, which means is configured to oscillate the traction sheave with a test torque after the control means of the machinery brake has controlled the machinery brake to open; a measuring means, which is configured to measure the movement of the elevator machine in connection with the oscillation; and a logic, which is configured to analyze the measurement results of the measuring means that are obtained in connection with the oscillation and to make the deduction that the machinery brake has not opened and has therefore failed if the machine does not move in connection with the oscillation.

According to a second aspect, the purpose of the invention is to enable detection of the failure of a machinery brake of an elevator without a person in the elevator car noticing that testing of the machinery brake of the elevator is ongoing.

This purpose can be resolved with a method wherein a shorter time is selected as the oscillation time than the time according to the displacement function of the elevator mechanics for transmitting movement of the traction sheave into movement of the elevator car, and with a method wherein a shorter time is selected as the oscillation time than the time according to the displacement function of the elevator mechanics for transmitting movement of the traction sheave into movement of the elevator car.

The preferred viewpoints and inventive embodiments of the invention are described in the dependent claims.

ADVANTAGES OF THE INVENTION

In the method for testing failure of a machinery brake of an elevator the machinery brake is controlled to open, after which the traction sheave is oscillated with a test torque. The movement of the elevator machine is measured in connection with the oscillation. If the machine does not move in connection with the oscillation, it is deduced that the machinery brake has not opened and has therefore failed.

The test system for testing failure of a machinery brake of an elevator comprises: a) a control means of the machinery brake for controlling the machinery brake to open; b) a control means of the machine, which means is configured to oscillate the traction sheave with a test torque after the control means of the machinery brake has controlled the machinery brake to open; c) a measuring means, which is configured to measure the movement of the elevator machine in connection with the oscillation; and d) a logic, which is configured to analyze the measurement results of the measuring means that are obtained in connection with the oscillation and to make the deduction that the machinery brake has not opened and has therefore failed if the machine does not move in connection with the oscillation.

By means of the method and test system presented in the preceding two paragraphs, insufficient opening of a machinery brake of an elevator can be detected and it can be verified that the requirement that driving against the brake of an elevator may not cause a dangerous situation, as specified in European Standard EN81-20 'Safety instructions for the construction and installation of lifts', is fulfilled.

Since in the method and test system a shorter time is selected as the oscillation time than the time according to the displacement function of the elevator mechanics for transmitting movement of the traction sheave into movement of the elevator car, the oscillation is not noticed in the elevator car. This enables testing of a machinery brake when the elevator car is manned.

When using the methods and systems described in the preamble in the aforementioned patent application publications for test measuring, the elevator cannot be used normally. For this reason, test measuring is performed at long intervals, e.g. only once per 24 hours, which can be too seldom for detecting unexpected failure of a machinery brake in sufficient time. With the method and test system according to a second aspect of the invention, opening of a machinery brake can be tested more often, because the oscillation does not cause movement of the elevator car.

Most preferably the method is performed in the control of the elevator and the test system is integrated into the control of the elevator. All the devices needed for controlling the elevator system can be controlled from the control of the elevator, from where also shutting the elevator out of use is possible.

Most preferably in the method and in the test system when it is deduced that the machinery brake is defective, a fault code is formed and the elevator is shut out of use. In this way the occurrence of dangerous situations can be better avoided.

The method and test system are used most preferably when the elevator car is stationary. In this way a dangerous situation caused by movement of the elevator can be better avoided. Likewise detection of moving of the machine of the elevator caused by vibration is easier.

The method and test system can be used when the elevator is in normal operation. In this way it is endeavored to obtain information as quickly as possible as to whether the machinery brake of an elevator does not open sufficiently.

BRIEF DESCRIPTION OF THE DRAWING

The FIGURE illustrates an elevator in accordance with example embodiments.

DETAILED DESCRIPTION

An elevator 1 that comprises a control/test system 10 according to the invention and in which the method according to the invention is used has an elevator car 20, which is driven with the hoisting machine of the elevator 1 by means of traction ropes traveling via the traction sheave 30 of the hoisting machine. The elevator 1 also comprises an electromechanical machinery brake 40, which engages with the traction sheave 30 or with the shaft of the hoisting machine to brake the traction sheave 30 and thus also the movement of the elevator car 20.

The electromechanical machinery brake 40 of the elevator 1 might be damaged if it does not open properly. The idea of the invention is to observe the braking torque produced by the brake utilizing a dynamic model of the elevator and of the machine.

The torque of the machinery brake 40 braking the machine can be measured e.g. when the elevator car 1 is stationary by rapidly oscillating the traction sheave 30. When the oscillation is sufficiently rapid, it is not noticed in the elevator car 1. The braking moment can also be isolated from the run-time behavior between the elevator car 1 and the traction sheave 30.

If the machinery brake 40 does not open properly, the increased friction is detected and the necessary procedures, such as fault codes and shutting the elevator 1 out of use can be executed.

The European Committee for Standardization (French: Comite Europeen de Normalisation) is currently preparing a new European Standard EN81-20 that is intended to replace European Standard EN81-1.

In connection with this, one working group was assigned to review the European Standard EN60204-1 to see which points of it are applicable to elevators. Clause 9.3.4 of the European Standard EN60204-1 requires that where a failure of a mechanical brake drive can result in a machinery brake being applied when the machinery of the elevator machine is energized and a hazardous situation can result as a consequence, the elevator shall be provided with a prevention system to switch off the machinery of the elevator machine The method and test system presented here for testing insufficient opening of a machinery brake of an elevator thus enable compliance with the requirements of Clause 9.3.4 of the European Standard EN60204-1. It is possible also that by means of the invention the requirements also of European Standards EN80-20 and prEN 81-20:2011-11 can be complied with better.

The invention must not be regarded as being limited only to the claims below but instead should be understood to include all legal equivalents of said claims and combinations of the embodiments presented.

The invention claimed is:

1. Method for testing failure of a machinery brake of an elevator, wherein in the method:

the machinery brake is controlled to open;

after this, the traction sheave is oscillated with a test torque;

the movement of the elevator machine is measured in connection with the oscillation;

if the machine does not move in connection with the oscillation, it is deduced that the machinery brake has not opened and has therefore failed.

2. Method according to claim 1, wherein a shorter time is selected as the oscillation time than the time according to the displacement function of the elevator mechanics for transmitting movement of the traction sheave into movement of the elevator car.

3. Method according to claim 1, which is performed in the control of an elevator.

4. Method according to claim 1, wherein when it is deduced that the machinery brake has failed, a fault code is formed and the elevator is shut out of use.

5. Method according to claim 1, which is used when the elevator car is stationary.

6. Method according to claim 5, which is used when the elevator is in normal operation.

7. Test system for testing failure of a machinery brake of an elevator, wherein the test system comprises:

a control means of the machinery brake for controlling the machinery brake to open;

a control means of the machine, which means is configured to oscillate the traction sheave with a test torque after the control means of the machinery brake has controlled the machinery brake to open;

a measuring means, which is configured to measure the movement of the elevator machine in connection with the oscillation; and a logic, which is configured to analyze the measurement results of the measuring means that are obtained in connection with the oscillation and to make the deduction that the machinery brake has not opened and has therefore failed if the machine does not move in connection with the oscillation.

8. Test system according to claim 7, wherein a shorter time is selected as the oscillation time than the time according to the displacement function of the elevator mechanics for transmitting movement of the traction sheave into movement of the elevator car.

9. Test system according to claim 7, which is integrated into the control of the elevator.

10. Test system according to claim 7, which is configured to form a fault code for shutting the elevator out of use when the logic has deduced that the machinery brake has failed.

11. Test system according to claim 7, which is used when the elevator car is stationary.

12. Test system according to claim 11, which is used when the elevator is in normal operation.

* * * * *